United States Patent [19]

Del Vecchio

[11] 4,143,618

[45] Mar. 13, 1979

[54] ELECTROLESS NICKEL PLATING APPARATUS

[76] Inventor: Evo Del Vecchio, 2 Worcester St., Clinton, Mass. 01510

[21] Appl. No.: 896,310

[22] Filed: Apr. 14, 1978

[51] Int. Cl.[2] ..... B05C 3/04

[52] U.S. Cl. ..... 118/603; 118/429

[58] Field of Search ..... 118/603, 610, 612, 429; 427/430 R, 430 A, 430 B, 435–438, 434 R, 434 A, 434 B, 434 C, 434 D; 204/242, 297 R; 220/444, 464, 468

[56] References Cited

U.S. PATENT DOCUMENTS

| | | | |
|---|---|---|---|
| 2,791,516 | 5/1957 | Chambers et al. | 118/603 X |
| 3,233,579 | 2/1966 | Aryidsson | 118/603 X |
| 3,727,680 | 4/1973 | Henry, Jr. | 118/429 X |
| 3,998,180 | 12/1976 | Hawkins et al. | 118/603 X |

*Primary Examiner*—Morris Kaplan

*Attorney, Agent, or Firm*—Charles R. Fay

[57] ABSTRACT

Electroless plating using alternate operative plating tanks of glass fiber reinforced urethane with polypropylene liners, and a third tank of cleaning fluid applied to the tank not being used.

1 Claim, 3 Drawing Figures

ELECTROLESS NICKEL PLATING APPARATUS

BACKGROUND OF THE INVENTION

Electroless plating is carried out in a single steel tank so that necessary cleaning is apt to delay or interrupt production. The longer a tank is used, the more difficult it is to clean. Prior art tanks are made of lined steel or stainless steel and thus are too heavy to be easily moved, and the evacuating pipes and pump are usually built into the tank, reducing operative volume and rendering operation and cleaning more difficult.

The object of this invention is to provide an electroless plating structure obviating these drawbacks.

DISCUSSION OF THE PRIOR ART

United States patents disclosing tanks and systems that might be used for electroless plating are:

U.S. Pat. No. 3,348,969 — Oct. 24, 1967
U.S. Pat. No. 3,556,839 — Jan. 19, 1971
U.S. Pat. No. 3,577,324 — May 4, 1971
U.S. Pat. No. 3,853,094 — Dec. 10, 1974
U.S. Pat. No. 3,955,532 — May 11, 1976

U.S. Pat. No. 3,348,969 shows a Teflon lined steel tank. The other patents illustrate ways of plating, but none disclose the alternate operative tank system, nor the urethane tank structure.

SUMMARY OF THE INVENTION

Apparatus for nickel plating using the electroless method includes a pair of operative solution tanks only one of which is in use at a time, together with a third tank containing a nitric cleaning material. When one operative tank has been used for a certain period of time it should be cleaned, and means is provided for pumping the solution therein into the other tank through a bag filter. The second tank may then be used to plate without interruption to the overall operation, and the now empty first tank is cleaned by the nitric material from the third tank. The nitric material cleans out any nickel particles or scum which may be left as a result of the plating operation and at the same time the second tank is being used for production. The method is to alternate the operative tanks and at each reversal of the fluid, the fluid enters into a clean tank insuring proper plating without flaws, etc. The third tank is elevated to provide a gravity flow.

The operative tanks have heretofore been made mainly of coated steel as disclosed in U.S. Pat. No. 3,348,969. The present invention improves on the prior art by providing tanks of a fraction the weight of the steel tanks while retaining rigidity, usefulness, and longevity and enhancing insulation, and this is accomplished by fabricating the tanks (in a rectangular shape) of urethane or similar material in sheets fully secured at the ends and edges thereof. This tank structure may be reenforced at the exterior sides and ends with e.g., fiberglass and has a liner in rectangular form of a stress relieved polypropylene with polypropylene fittings.

The operative tanks are provided with drains connected to exterior pipes exhausted by an exterior pump leading the solution from above into the other tank through a bag filter, so that as little apparatus is located within the tanks as possible. Air agitation is provided by a specially designed air sparger and sets up a flow pattern in the solution which not only helps to eliminate hydrogen bubbles retained on the parts during the Electroless Nickel reduction process, but directionalizes particulate matter to strategically located pump intakes between the sparger legs. Therefore, the common problem of pitted and rough deposits is largely eliminated.

PREFERRED EMBODIMENT OF THE INVENTION

Figure 1:
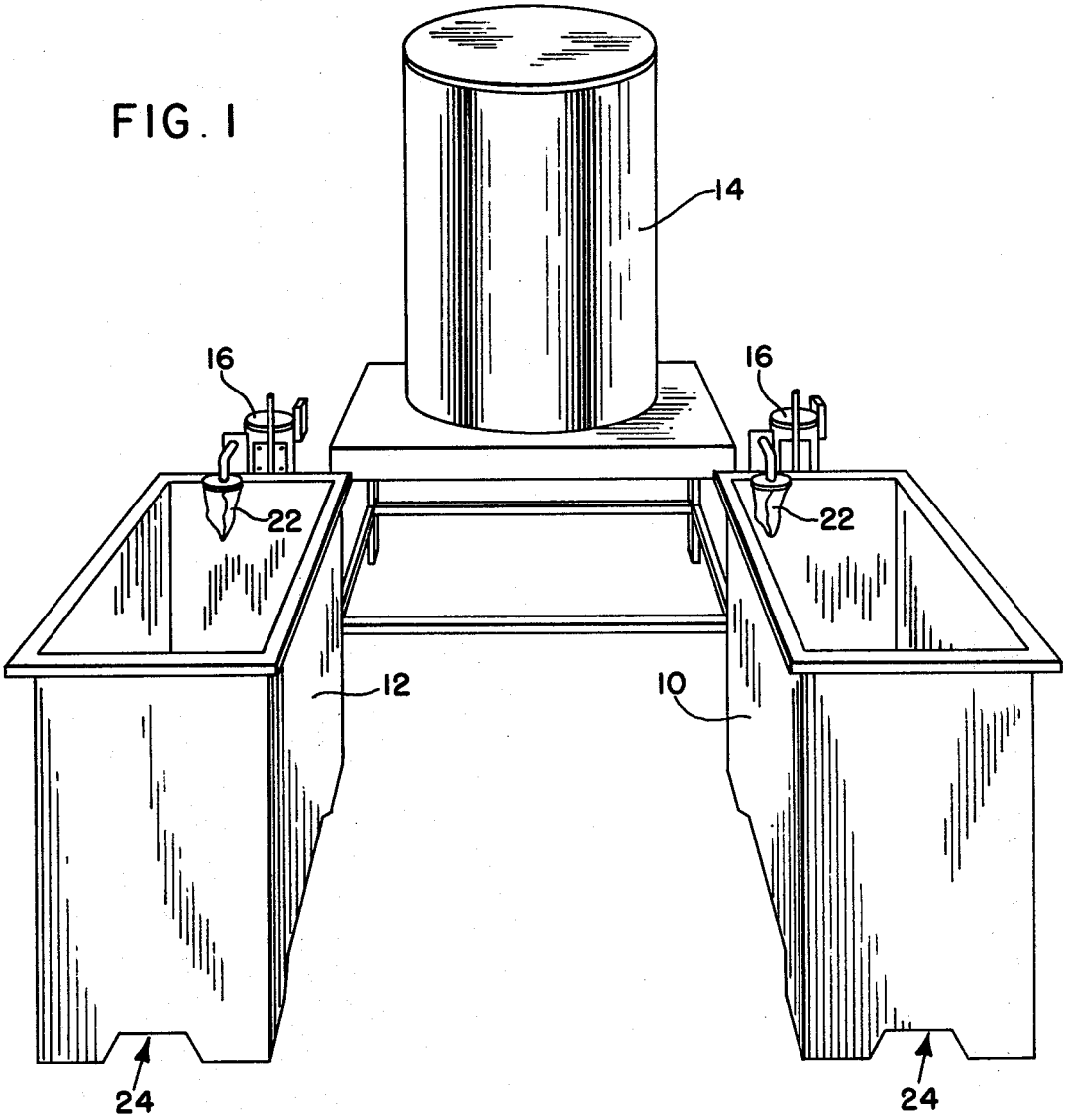
FIG. 1 is a perspective view illustrating the alternate operative tank system.

FIG. 1 illustrates the alternative operative tank system with a third tank for cleaning material located convenient to the plating tanks. The latter are indicated at 10 and 12 and the cleaner tank at 14. Only so much of the system is shown as will describe the invention. The plating tanks may have agitators, mechanical or fluid, as shown by the prior art, heaters, etc. The center or third tank 14 contains a tank cleaner which may be a nitric material. This tank is preferably located above the others and thus provides a gravitational feed system for the nitric acid eliminating the necessity for costly nitric pumps and the man hours spent manning the pumping operation.

Each plating tank has a pump 16, 16, completely outside its respective tank. These pumps are used to pump plating liquid from one tank to the other through underside drains and pipes 18, 20, also completely outside the tanks, using disposable bag filters 22 to strain unwanted particles. The special design of the bag holder eliminates slippage of the bag filter which might other wise result in spraying hot solution over the area. It thereby becomes a safety feature, see copending application Ser. No. 896,367, filed Apr. 14, 1978. Thus one tank or the other is always ready to late, eliminating down time and minimizing maintenance in general. When the operator determines that the change is needed, he can merely actuate requisite valves for this purpose, flushing cleaning fluid into the empty tank and pumping it out as needed. Timed operation is also possible as is sensored timing if wanted.

Figure 2:
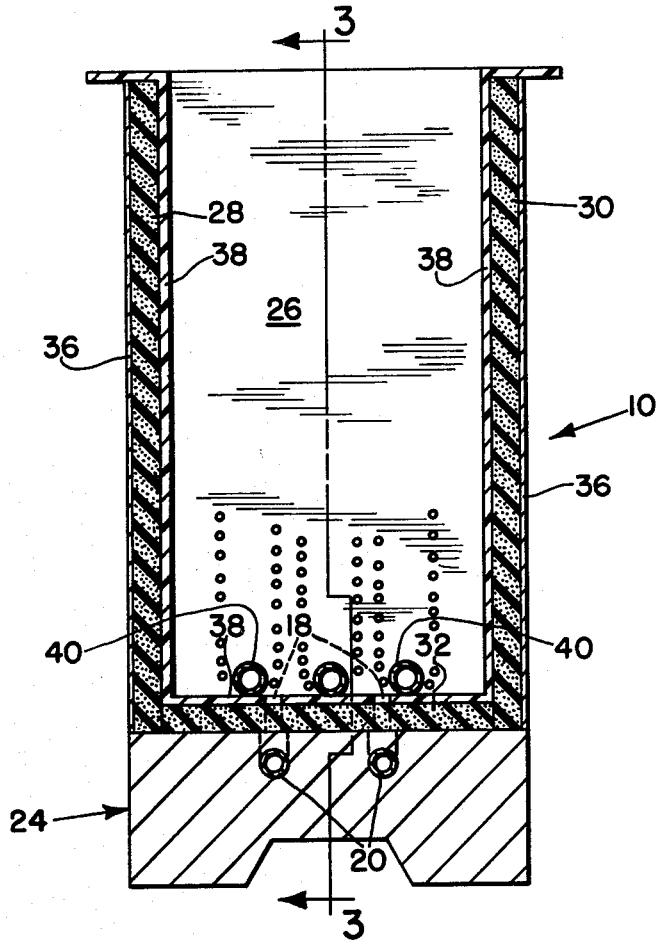
FIG. 2 is a transverse section through a tank.
Figure 3:
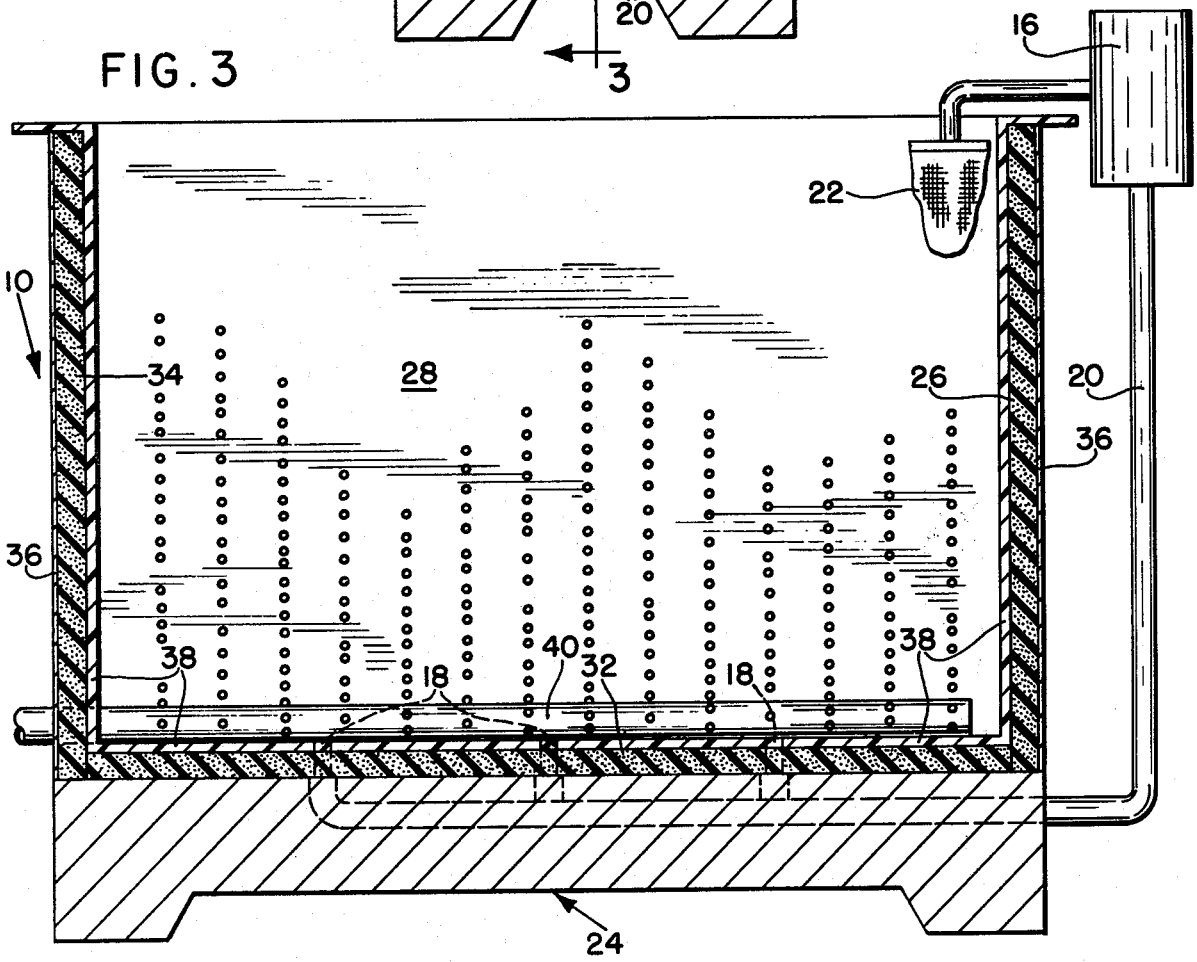
FIG. 3 is a longitudinal section on line 3—3 of FIG. 2.

The novel tanks 10 and 12 may be mounted on any kind of legs or stand 24 in which drain pipes 20 may be located. These tanks are made from five rectangular or square sheets of cellular urethane firmly secured at the mating edges to form a rectangular tank with square corners. FIG. 2 includes one end 26, two sides 28 and 30, and the bottom 32, and FIG. 3 shows the front end 34. This is a very light weight tank and can be exteriorly reenforced as by fiberglass 36, with suitable ribbing if needed.

The interior of the tank that comes in contact with the plating solution and the cleaning fluid, is an open top liner 38 of stress released polypropylene, likewise formed of rectangular or square sheets connected together to form permanent leakproof corners that are exactly square. The liner is provided with a surrounding edge lip or shelf that is strong enough to permit the application of appurtenances thereto.

The entire tank is light enough to be easily man-handled and transported as compared to the prior art steel tanks but also is long lasting and easily fabricated inexpensively.

This open-flow filter system allows turning the bath over at a high rate (10 times +/hr.) with smaller pumping units. It also saves the expense of the normal coretype filters which must be changed and discarded more often to maintain any flow rate at all.

The welded-in bottom plumbing allows a "sweeping" action of free-flowing particulate matter at the base of the flow pattern which enables this particulate matter to be more readily removed than when a common pump intake or bulkhead fitting drain with a flange is used.

The air agitation is provided by two or more branches 40 supplied by air under pressure in any convenient way from the outside of the tanks and having alternate orifices at the undersides of the branches to create the air stream pattern shown in FIG. 2.

I claim:

1. Apparatus for electroless plating comprising:

a pair of plating tanks;

a drain for each tank;

a pump operatively associated with each drain;

a disposable filter bag located within each tank at the opening thereof;

means operatively connecting said disposable filter bags, drains, pumps and tanks whereby plating solution may be pumped from each tank to the other to effect alternative use of the plating tanks;

a source of cleaning fluid;

means for selectively communicating said source with said tanks whereby one tank may be cleaned while the other tank plates;

said tanks each comprising a cellular urethane having an exterior reinforcing layer of fiberglass and an interior rigid and removable liner of polypropylene having a flange element overlying the urethane and fiberglass edges; and a branched perforated pipe means disposed within and at the bottom of each tank and connected to a pressurized air supply whereby to provide an agitator means.

* * * * *